US005497534A

United States Patent [19]

Caruso

[11] Patent Number: 5,497,534

[45] Date of Patent: Mar. 12, 1996

[54] DOUBLE ARM HINGE FOR A REFRIGERATOR DOOR

[75] Inventor: Jerome Caruso, Lake Forest, Ill.

[73] Assignee: Sub-Zero Freezer Company, Inc., Madison, Wis.

[21] Appl. No.: 338,415

[22] Filed: Nov. 14, 1994

Related U.S. Application Data

[63] Continuation of Ser. No. 4,750, Jan. 14, 1993, abandoned.

[51] Int. Cl.[6] ..... E05D 03/06; E05D 05/02; E05D 11/10

[52] U.S. Cl. ..... 16/288; 16/291; 16/294; 16/370; 16/371

[58] Field of Search ..... 16/287, 288, 291, 16/293, 294, 295, 296, 302, 366, 370, 371, 286, 304

[56] References Cited

U.S. PATENT DOCUMENTS

| | | | |
|---|---|---|---|
| 1,888,345 | 11/1932 | Cummings | 16/370 |
| 2,091,673 | 8/1937 | De Orlow | 16/370 |
| 2,162,135 | 6/1939 | Tell | 16/288 |
| 2,355,542 | 8/1944 | Loftin | 16/371 |
| 2,520,921 | 9/1950 | Foster | 16/288 |
| 2,674,761 | 4/1954 | Weiss | 16/288 |
| 2,740,155 | 4/1956 | Hammond | 16/288 |
| 2,840,847 | 7/1958 | Danser | 16/288 |
| 3,234,584 | 2/1966 | Valade | 16/288 |
| 3,523,323 | 8/1970 | Jorgensen | 16/302 |
| 4,157,599 | 6/1979 | Holmes | 16/302 |
| 4,564,975 | 1/1986 | Kuffner | 16/366 |

FOREIGN PATENT DOCUMENTS

| | | | |
|---|---|---|---|
| 2574108 | 6/1986 | France | 16/370 |
| 2407973 | 9/1974 | Germany | 16/302 |
| 3239989 | 5/1984 | Germany | 16/304 |
| 2234 | 3/1910 | United Kingdom | 16/370 |

OTHER PUBLICATIONS

European Patent No. 0,004,023, pub. Sep. 1979 inventor: Claus Winter.

*Primary Examiner*—Lowell A. Larson
*Assistant Examiner*—Donald M. Gurley
*Attorney, Agent, or Firm*—Foley & Lardner

[57] ABSTRACT

A refrigerator door hinge assembly including a refrigerator bracket and a door bracket, a first link pivotally connected to the refrigerator bracket and the door bracket, a second link pivotally connected to the refrigerator bracket and the door bracket, the distance between the pivot connections of the second link being greater than the distance between the pivot connections of the first link, each of the first and second links being located in different but parallel planes and include a surface which engages the inner wall of the door bracket when the door is in the closed position thereby maintaining the parallel relation between the door and the refrigerator.

10 Claims, 6 Drawing Sheets

FIG. 11
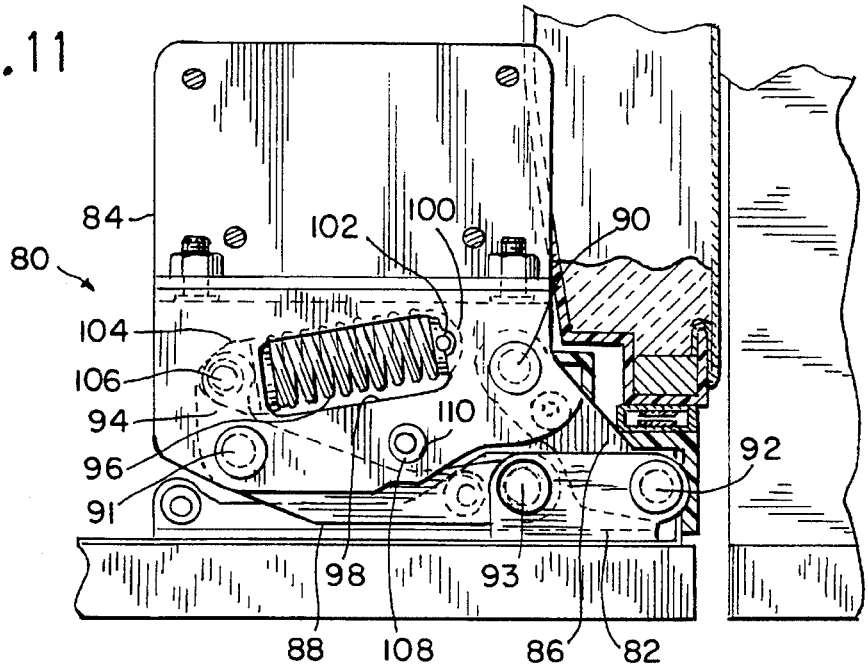
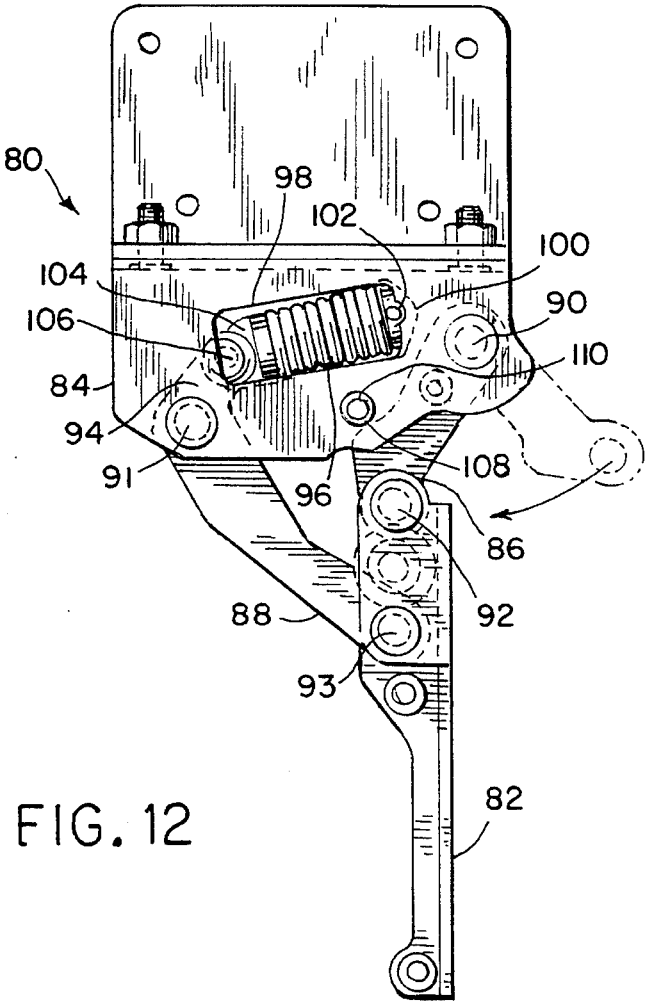
FIG. 12

DOUBLE ARM HINGE FOR A REFRIGERATOR DOOR

This is a continuation of U.S. Ser. No. 08/004,750 filed on Jan. 14, 1993, now abandoned, entitled DOUBLE ARM HINGE FOR A REFRIGERATOR DOOR.

FIELD OF THE INVENTION

The present invention relates to refrigerator hinge structures and more particularly to a double linkage hinge for imparting a planar movement to a refrigerator door prior to pivoting the door to an open position.

BACKGROUND OF THE INVENTION

Refrigerators of the type contemplated herein are built into a wall cabinet and generally include a panel type door which is aligned in close proximity to the wall panels so that only a very narrow gap exists between the refrigerator door and the adjoining wall panels. In order to maintain the aesthetic characteristics of the front of the wall the hinges must be hidden and capable of supporting the door such that it can be opened within the space between the adjoining cabinet panels.

A quadrilateral hinge structure for a panel door cabinet structure is shown in U.S. Pat. No. 4,083,082, entitled "Concealed Self-Closing Hinge For Panel Door Cabinet Structure," issued on Apr. 11, 1978, to Frank A. Holmes. This linkage includes a link having a cam extension that cooperates with a spring conveniently mounted in one of the hinge leaves. The spring cooperates with the cam extension to provide self-closing features by allowing the pivot point of one of the links to yieldingly move to a pivot position under increasing stress of a spring. A novel spring stop is incorporated in the hinge structure to absorb shock whereby the imposition of high forces is precluded. However, there is no provision for providing clearance for the initial pivotal motion of the door, thus requiring sufficient space between the door and the wall panels.

SUMMARY OF THE PRESENT INVENTION

The double link hinge according to the present invention includes a door bracket and a refrigerator bracket connected by a pair of links of different lengths. The pivot points of the links on the door bracket being located on a line parallel to the front of the door panel. The links are angularly offset to initially move the door outwardly from the refrigerator prior to pivoting the door to an open position. On closing the links also provide a positive stop of the pivotal movement of the door to seal the door to the frame of the refrigerator. One of the links is provided with an extension which is positioned to engage a spring to provide a bias force on closing the door and a bias force holding the door in the fully open position.

Other principal features and advantages of the invention will become apparent to those skilled in the art upon review of the following drawings, the detailed description and the appended claims.

BRIEF DESCRIPTION OF THE DRAWINGS

FIG. 11 is a top view of an alternate embodiment of the hinge; and

FIG. 12 is a view of the hinge of FIG. 11 shown in the open position.

Figure 1:
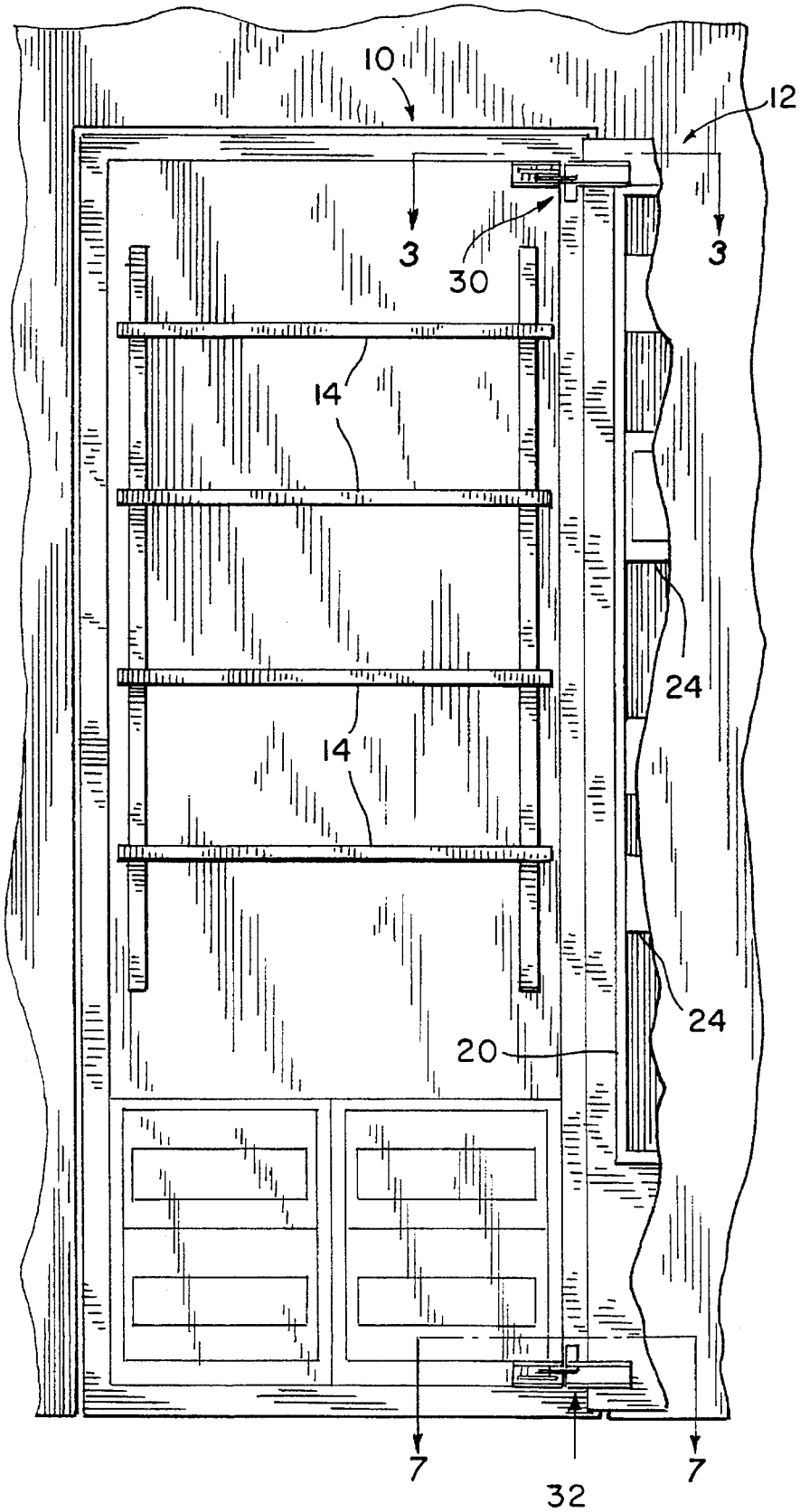
FIG. 1 is a front view of a refrigerator recessed into the kitchen cabinetry.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

Figure 2:
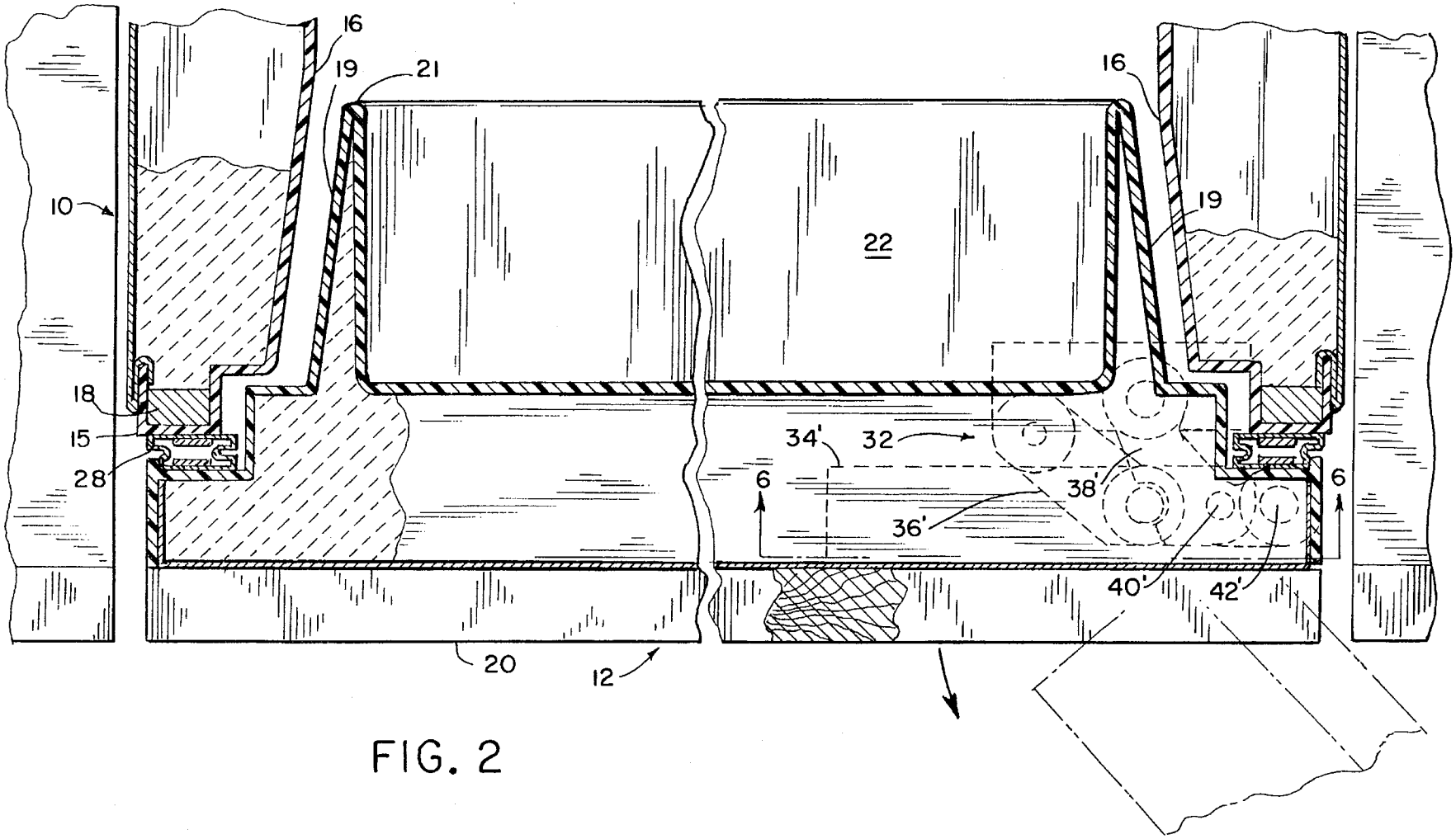
FIG. 2 is a top view in section showing the refrigerator door in a closed position.
Figure 4:
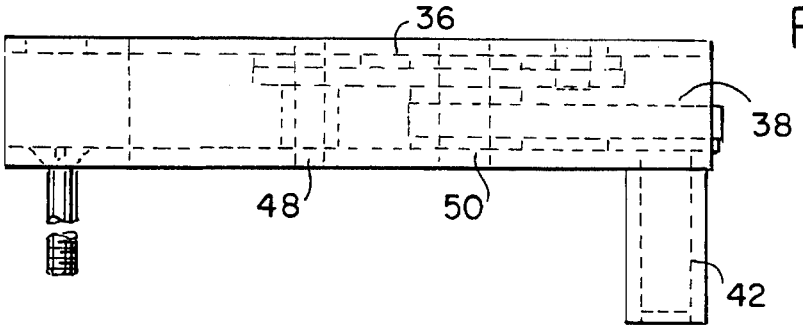
FIG. 4 is a view taken on line 4—4 of FIG. 3.

The refrigerator illustrated in FIGS. 1 and 2 is of a conventional construction having a cabinet 10 and a door 12. The cabinet generally includes a number of shelves 14 mounted within the cabinet frame 15 which angles outwardly at 16 to accommodate the door 12. A magnet 18 is provided around the periphery of the frame 15. The door 12 generally includes a door panel 20 and an inner frame 21 which defines a recess 22 on the inside of the door. A number of shelves 24 may be seated within the recess 22. A magnetic seal 28 is provided around the inner periphery of the inner frame 21. The seal 28 is positioned to engage the frame 15 opposite the magnet 18. The frame 21 angles inwardly at 19 in a parallel relation to the angled surface 16 and terminates at 21 forming a dike around the interior of the door. It should be noted that the door must initially move in a straight line to clear the end of the dike 21 from the frame 15.

In accordance with the present invention the door is supported by a hinge assembly 30 at the top of the refrigerator and a hinge assembly 32 at the bottom of the refrigerator. Each of the hinge assemblies 30 and 32 includes a door bracket 34 and a pair of links 36 and 38 pivotally connected to the door bracket by pins 40 and 42, respectively. The top hinge assembly 30 includes a refrigerator bracket 44. The lower hinge assemble 32 includes a refrigerator bracket 46. The links 36 and 38 are pivotally connected to the refrigerator brackets 44 and 46 by pins 48 and 50, respectively.

It should be noted that the pins 40 and 42 are aligned with a line 52 which is parallel to the plane of the door. Each of the links 36 and 38 includes a surface 54 and 56, respectively, which engages the inner wall of the door bracket when the door is in the closed position, thereby maintaining the parallel relation between the axis of the pins 40, 42 and the plane of the door. The distance between the pivot points of link 38 is shorter than the distance between the pivot points of the link 36. With this arrangement the door will start to pivot about pin 40 and is restrained by pin 42. As the door frame clears the cabinet the link 38 which is shorter than the link 36 accelerates the pivotal movement of the door so that it opens completely in a small amount of pivotal movement of the hinge assembly.

Figure 3:
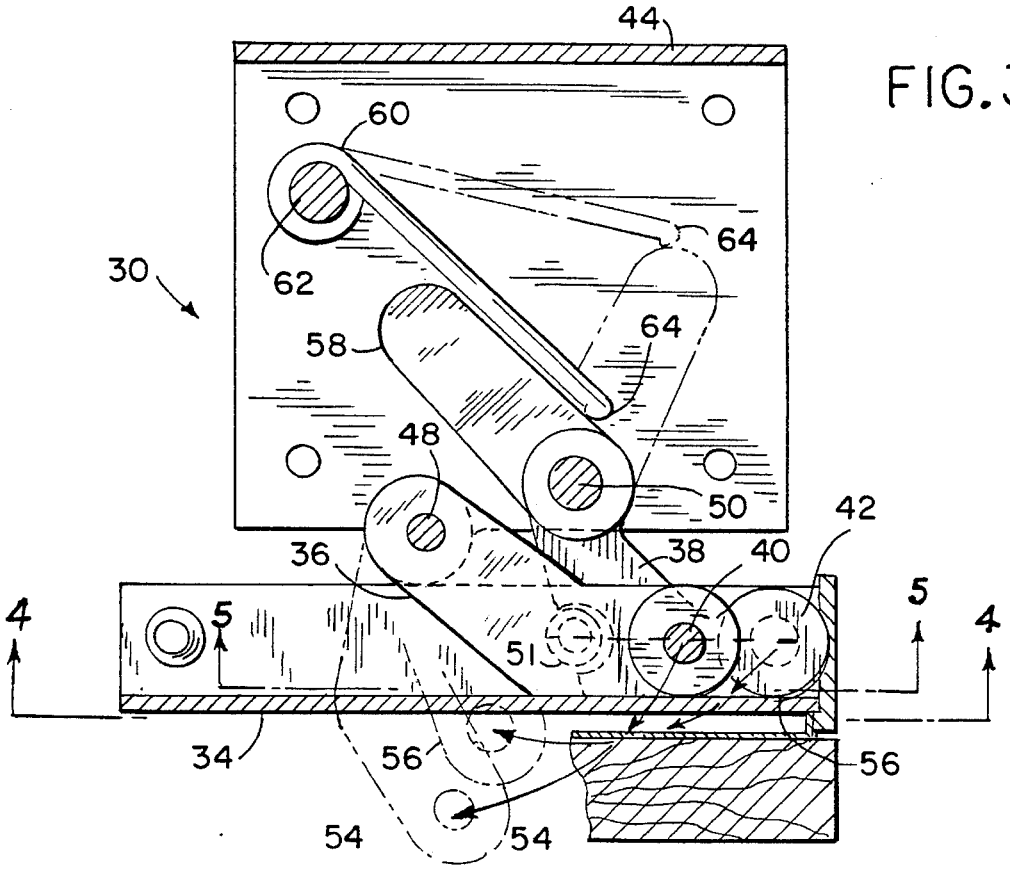
FIG. 3 is a top view of the top hinge assembly shown in the closed position.
Figure 5:
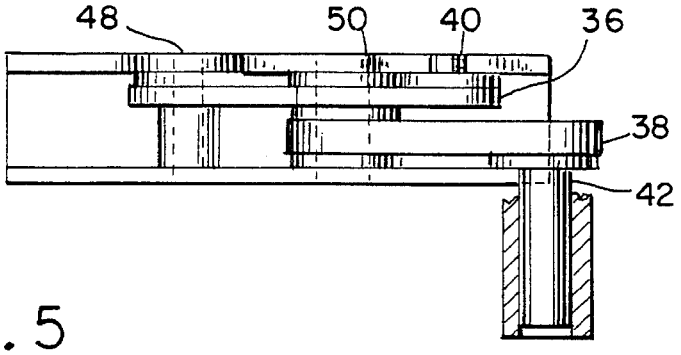
FIG. 5 is a view taken on line 5—5 of FIG. 3.
Figure 7:
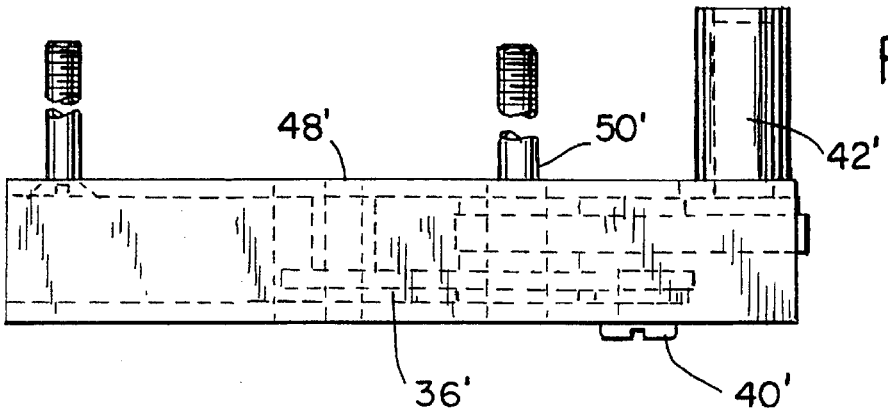
FIG. 7 is a view taken on line 7—7 of FIG. 6.
Figure 6:
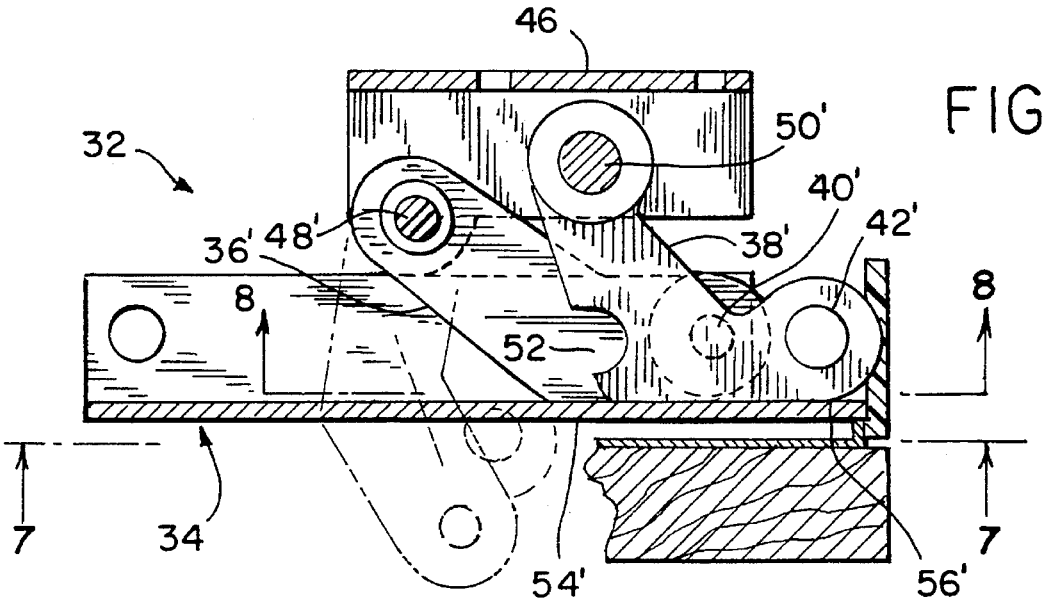
FIG. 6 is a top view of the bottom hinge in the closed position.
Figure 8:
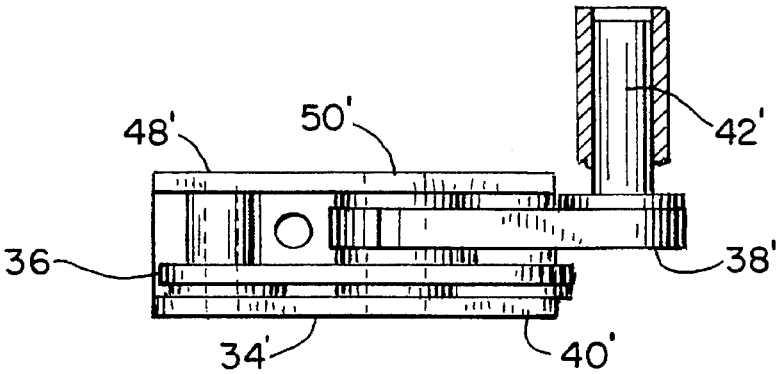
FIG. 8 is a view taken on line 8—8 of FIG. 6.
Figure 9:
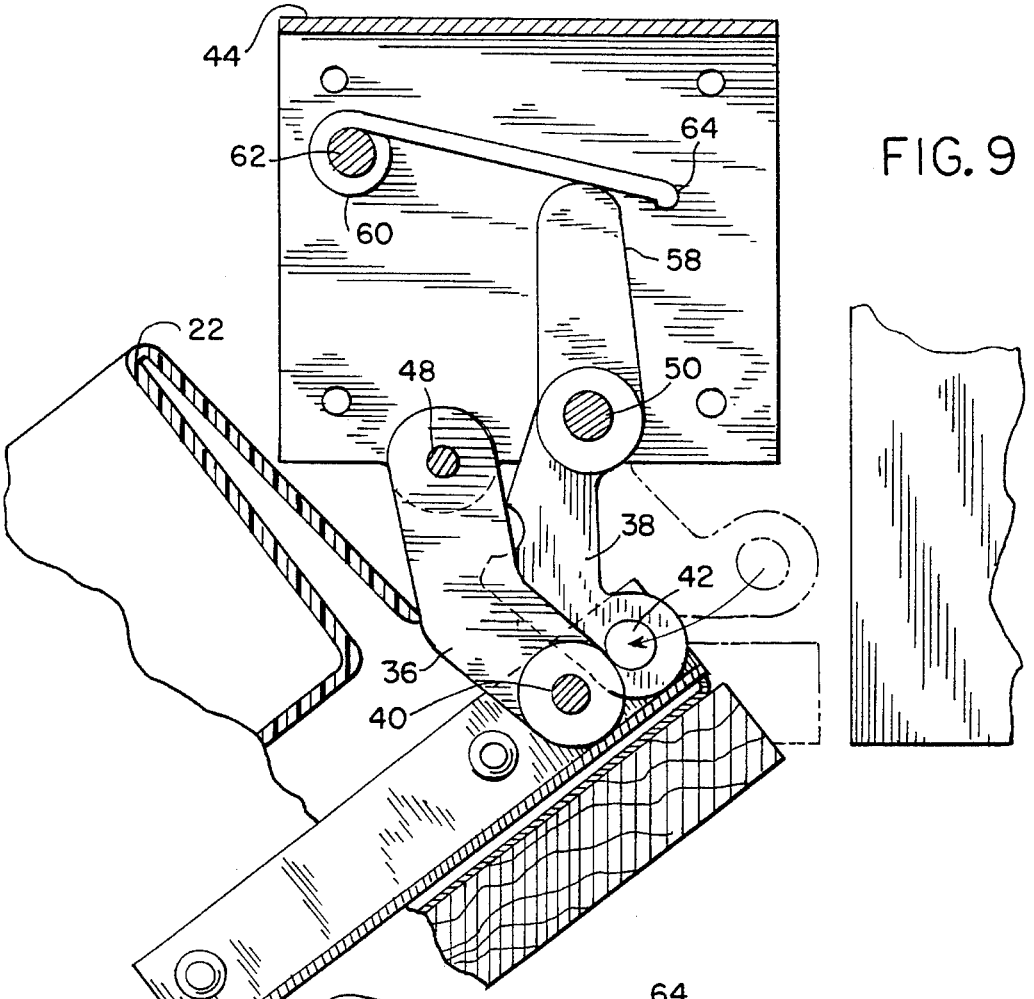
FIG. 9 is a view similar to FIG. 2 showing the top hinge assembly in a partially opened position.
Figure 10:
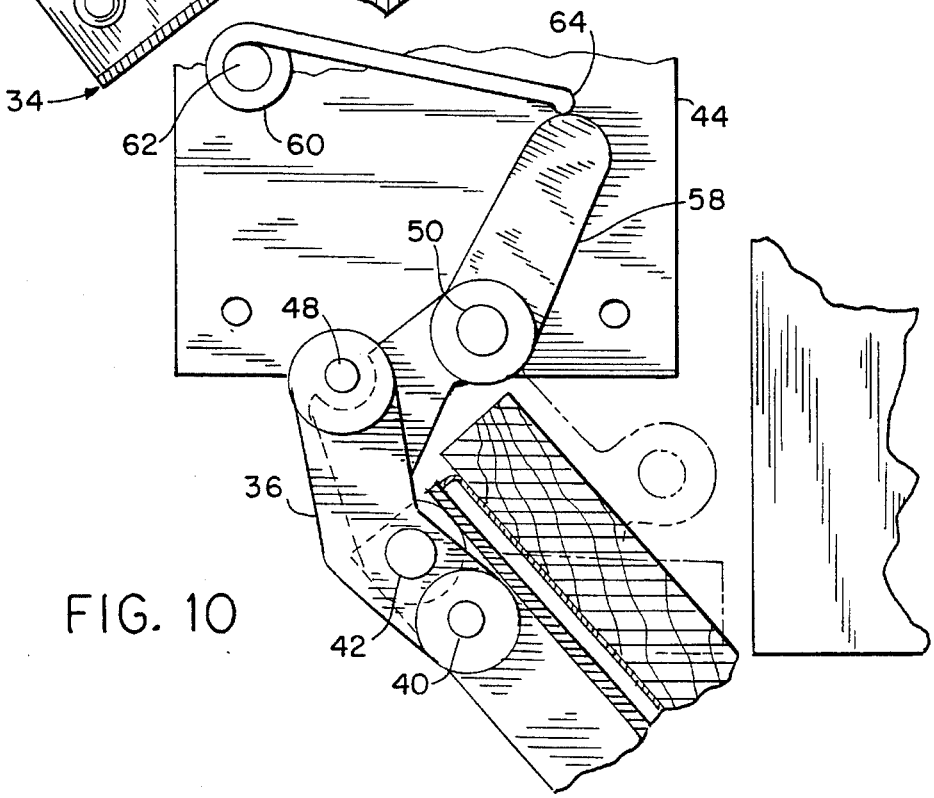
FIG. 10 is a view similar to FIG. 9 showing the top hinge assembly in the fully opened position.

Means are provided for biasing the door in an open or closed direction. In this regard, and referring to FIGS. 3, 9 and 10, an extension 58 is shown formed on the end of the second link 38 in the refrigerator bracket 44. A coil spring 60 is mounted on a pin 62 in the refrigerator bracket 44. One end of the spring 60 is anchored to the bracket 44 and the other end 64 of the spring extends angularly across the bracket 44 to a position adjacent to the extension 58. As the door is opened, the extension 58 is rotated into engagement with the end 64 of spring 60. The spring 60 will initially bias the door toward the closed position, as shown in FIG. 9, until the extension 58 passes the end 64 of spring 60. When the center of extension 58 passes over the end 64 of spring 60 the force of the spring will change biasing the extension 58 in the open direction as shown in FIG. 10. The door will be biased to the open position.

In an alternate embodiment of the invention as shown in FIGS. 11 and 12 a hinge assembly 80 is shown which can be mounted on either the top or the bottom of the refrigerator. The hinge assembly 80 includes a door bracket 82 and a refrigerator bracket 84, the brackets 82 and 84 being connected by a pair of links 86 and 88. The link 86 being connected to the refrigerator bracket 84 by pin 90 and to the door bracket 82 by pin 92. The link 88 being connected to the refrigerator bracket 84 by pin 91 and to the door bracket 82 by pin 93.

As noted above, the axis of the pins 92 and 93 on the door bracket 82 are aligned with a line parallel to the plane of the door. The distance between the pivot points of the pins 90 and 92 for the link 86 is shorter than the distance between the pivot points 91 and 93 for the link 88. With this arrangement the initial movement of the door is restrained by pin 92 in link 86 as the door moves outwardly from the frame of the cabinet. The door will then start to pivot open about the pin 93 in the door bracket. The link 86 will rotate the door about pin 93 in the door bracket.

Means are provided for biasing the door in both the open and closed directions. In this regard, FIGS. 11 and 12, an extension 94 is shown formed on one side of the second link 88. A compression spring 96 is mounted in an elongate opening 98 in the bracket 84. One end of the spring is secured to a bracket 100 which is mounted on a pin 102 at one end of the opening 98. The other end of the spring 96 includes a bracket 104 which is pivotally mounted on a pin 106 on the end of extension 94. As the door opens the link 88 will rotate clockwise about pin 91 compressing the spring 96 as shown in FIG. 12. When the pin 92 on the door bracket 82 passes through a line drawn between the axis of the pin 90 on the link 86 and the axis of the pin 93 on the link 88 the compression spring will bias the door bracket to the open position. If it is desired to limit the opening motion of the door a roll pin 108 may be provided in the opening 110 in the refrigerator bracket in a position to engage the edge of the link 86.

Thus, it should be apparent that there has been provided in accordance with the present invention a double arm hinge for a refrigerator door that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A hinge assembly for pivotally mounting a door in a parallel relation to a refrigerator, said assembly comprising:

a first bracket mounted on the refrigerator, a second bracket mounted on the door, the second bracket having an inner wall, a first link having one end pivotally connected to the first bracket and the other end pivotally connected to the second bracket, and a second link having one end pivotally connected to the first bracket and the other end pivotally connected to the second bracket, each of the first and second links including a surface which engages the inner wall of the door bracket when the door is in the closed position, and means for directly biasing one of said first or second links in both an opening and closing direction thereby maintaining the parallel relation between the door and the refrigerator, said links being located in different but parallel planes and being of different lengths to determine the course of movement of the door and a pin for limiting the opening motion of said door.

2. The hinge assembly according to claim 1 wherein said first link includes an extension on one end and said biasing means is positioned to engage said extension to bias the door in both a door opening and closing direction.

3. The hinge assembly according to claim 1 wherein said second link includes an extension on one end and said biasing means is positioned to engage said extension to bias the door in both a door opening and a door closing direction.

4. A hinge assembly for pivotally mounting a door in a parallel relation to a refrigerator, the assembly comprising:

a refrigerator bracket and a door bracket having an inner wall, a first link pivotally connected to said refrigerator bracket and said door bracket, a second link pivotally connected to said refrigerator bracket and said door bracket in a spaced relation to said first link, each of the first and second links including a surface which engages the inner wall of the door bracket when the door is in the closed position to maintain the parallel relation between the door and the refrigerator, said first and said second links lie in different but parallel planes, the distance between the pivot connections of said second link being greater than the distance between said pivot connections on said first link, and means for directly biasing said first link in both an opening and closing direction whereby said door bracket pivots about said pivot connections to said links to an open position.

5. The hinge assembly according to claim 4 wherein said biasing means includes an extension on one end of said first link and said biasing means is positioned to directly engage said extension to bias the door in both a door opening and closing direction.

6. The hinge assembly according to claim 4 wherein said second link includes an extension on one end and said biasing means is positioned to directly engage said extension to bias the door in both a door opening and closing direction.

7. A concealed hinge assembly for pivotally mounting a door in a parallel relation to a cabinet type refrigerator, said assembly comprising:

a door bracket mounted on the top and bottom of the inside of the door, each door bracket having an inner wall, a cabinet bracket mounted on the top and bottom of the refrigerator, a first lever arm pivotally connected to each of said top and bottom door brackets and cabinet brackets, a second lever arm pivotally connected to each of said top and bottom door brackets and cabinet brackets, each of the first and second lever arms including a surface which engages the inner wall of the door bracket when the door is in the closed position to maintain the parallel relation between the door and the refrigerator, said first lever arm and said second lever arm lie in different but parallel planes, the pivotal connection of said first lever arm and said second lever arm to said door bracket being located on a line parallel to the plane of the door and means for directly biasing one of said first or second links in both an opening and closing direction.

8. The assembly according to claim 7 including means for directly limiting the opening motion of said door.

9. The assembly according to claim 8 wherein said limiting means comprises the pivot for the first lever arm, said pivot being located in the path of motion of the second lever arm.

10. The assembly according to claim 9 wherein said limiting means includes a ring mounted on said pivot for said first lever arm.

* * * * *